US005855345A

United States Patent [19]

DiMaggio

[11] Patent Number: 5,855,345

[45] Date of Patent: Jan. 5, 1999

[54] DISPLAY

[76] Inventor: Anthony DiMaggio, 28001 Southfield Rd., Lathrup Village, Mich. 48076

[21] Appl. No.: 654,917

[22] Filed: May 29, 1996

[51] Int. Cl.[6] ..... F16M 11/00

[52] U.S. Cl. ..... 248/176.1; 248/150; 248/346.03; 248/346.11; 206/6.1; 206/303; 206/493

[58] Field of Search ..... 248/150, 346.03, 248/346.11, 176.1; 206/6.1, 303, 493, 495; 211/13

[56] References Cited

U.S. PATENT DOCUMENTS

| | | | |
|---|---|---|---|
| 329,018 | 10/1885 | Coffin | 211/13 |
| 2,235,283 | 3/1941 | Carver | 248/176.1 X |
| 2,591,349 | 4/1952 | Goebel | 248/127 X |
| 3,365,154 | 1/1968 | Hofmann | 248/176.1 X |
| 3,452,663 | 7/1969 | Machtig | 248/187 |
| 4,646,920 | 3/1987 | Kruger | 211/13 |
| 5,031,778 | 7/1991 | Edgecombe | 248/176.1 X |

*Primary Examiner*—Carl D. Friedman
*Assistant Examiner*—W. Glenn Edwards
*Attorney, Agent, or Firm*—Bliss McGlynn, P.C.

[57] ABSTRACT

A display for holding objects includes a base having a recess, a projection extending from the base and into the recess, and a sleeve disposed about the projection to hold a portion of an object in the recess between the sleeve and the base.

19 Claims, 1 Drawing Sheet

DISPLAY

BACKGROUND OF THE INVENTION

1. Field of the Invention

The present invention relates generally to displays and, more particularly, to a display for displaying objects such as jewelry.

2. Description of the Related Art

It is known to provide displays for objects such as jewelry. One example of such a display is used for holding a ring. Typically, the display has a base with a cylindrical projection extending upwardly and outwardly at an angle in the form of a finger. The ring is disposed on the finger such that the finger extends through the ring until the outer diameter of the finger increases to cause an interference fit with the inner diameter of the ring. Although these displays have worked well, there is a need in the art to provide a display for holding an object of jewelry such as a ring.

SUMMARY OF THE INVENTION

It is, therefore, one object of the present invention to provide a display for holding objects.

It is another object of the present invention to provide a display for holding jewelry.

It is yet another object of the present invention to provide a display for holding a ring.

To achieve the foregoing objects, the present invention is a display for holding objects including a base having a recess, a projection extending from the base and into the recess, and a sleeve disposed about the projection to hold a portion of an object in the recess between the sleeve and the base.

One advantage of the present invention is that a display is provided for holding objects such as jewelry. Another advantage of the present invention is that the display is used for holding a ring. Yet another advantage of the present invention is that the display has a pin with a compressible sleeve for extremely reliable holding power for a ring like object to be held at desired angles and positions.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
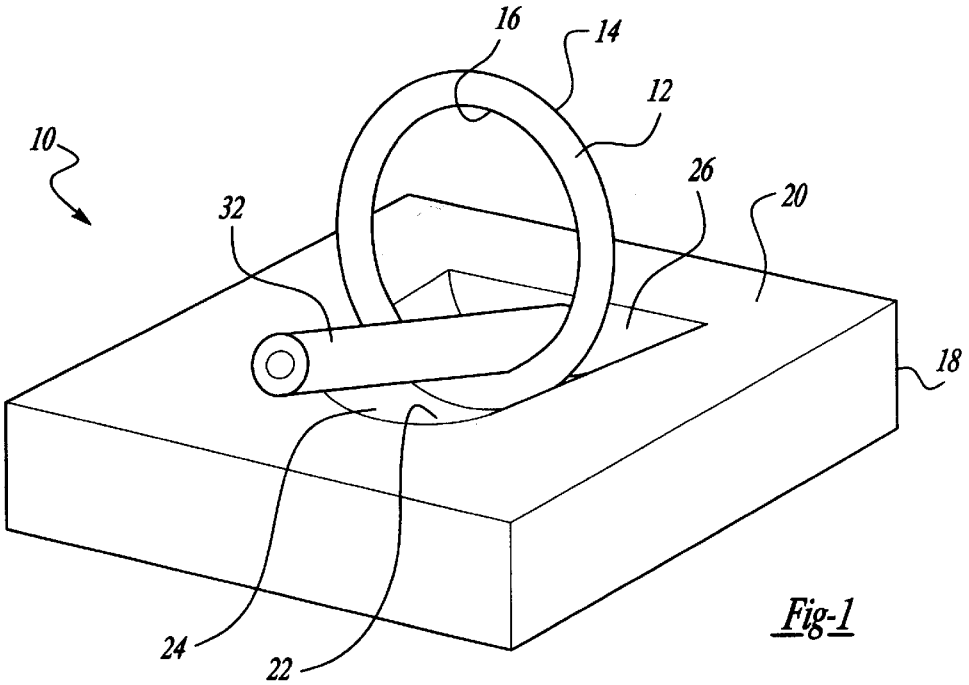
FIG. 1 is a perspective view of a display, according to the present invention, illustrated in operational relationship with an object.
Figure 2:
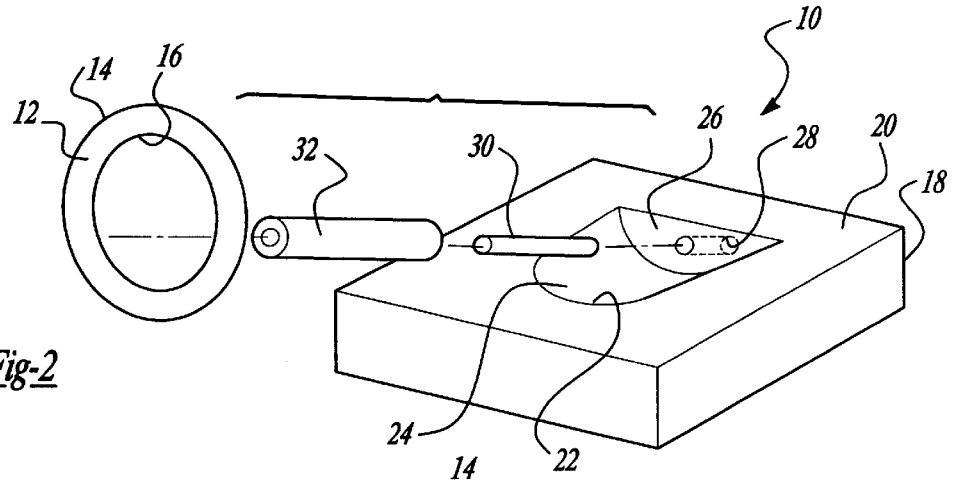
FIG. 2 is an exploded perspective view of the display and object of FIG. 1.
Figure 3:
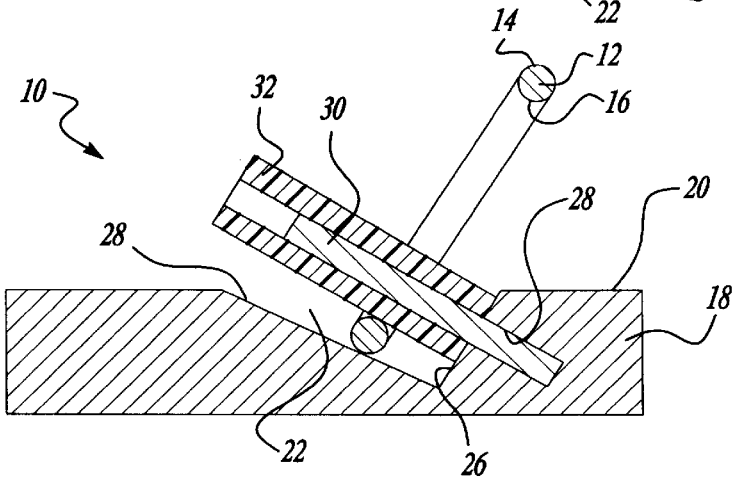
FIG. 3 is a fragmentary elevational view of the display and object of FIG. 1.

Referring to FIGS. 1 through 3, a display 10, according to the present invention, is illustrated in operational relationship with an object. The display 10 is used for holding and displaying the object such as of jewelry. In this example, the object is a ring like object or ring 12. The ring 12 is generally circular in shape and has an outer diameter surface 14 and an inner diameter surface 16. It should be appreciated that the ring 12 may be of various shapes and sizes but has a generally circular shank as is known in the art.

The display 10 includes a base 18 having an upper surface 20. Preferably, the base 18 is generally rectangular in shape. The base 18 includes a recess 22 in the upper surface 20. The recess 22 is generally elongated and concave to be complementary to the outer diameter surface 14 of the ring 12. The recess 22 also has a front surface 24 extending at an angle from the upper surface 24 into the base 18 and a rear surface 26 extending at an angle from the end of the front surface 24 to the upper surface 20 of the base 18. The rear surface 26 includes at least one cavity 28 for a function to be described. The rear surface 26 may have up to seven cavities 28 at various locations and of various diameters. Preferably, the cavity 28 is located above the front surface 24 to allow a space of approximately one to two millimeters between the cavity 28 and front surface 24. The axis of the cavity 28 should be generally parallel to the axis forming the front surface. The base 18 is made of a rigid material such as plastic. The base 18 may be made of a transparent material. It should be appreciated that any suitable rigid material may be used.

The display 10 also includes a projection or pin 30 attached to the base 18. The pin 30 is generally cylindrical in shape with a circular cross-section. The pin 30 has a portion disposed in the cavity 28 and forms a friction fit due to the outer diameter of the pin 30 and the inner diameter of the cavity 28 and the surface tension of the material used. The pin 30 is made of a semi-rigid material such as plastic. The pin 30 is not malleable and has a sufficient memory when flexed. The pin 30 extends out of the cavity 28 two to five times longer than the portion inserted into the cavity 28.

The display 10 further includes a sleeve 32 disposed over the pin 30. The sleeve 32 is generally a cylindrical tube having an inner diameter matching the outer diameter of the pin 30. The sleeve 32 is made of a compressible material such as plastic tubing. The sleeve 32 has a radial thickness of one half to one millimeter. It should be appreciated that the space between the outer surface of the pin 30 and front surface 24 is lessened by the addition of the sleeve 32 about the pin 30. It should also be appreciated that the sleeve 32 is compressed due to an interference fit between the thickness of the ring 12 and the space between the outer surface of the sleeve 32 and the front surface 24.

In operation, a ring 12 is disposed in the recess 22 and about the pin 30 and sleeve 32. As the ring 12 is moved toward the rear surface 26 of the recess 22, the outer surface 14 of the ring 12 contacts the front surface 24 of the base 18 and the inner surface 16 of the ring 12 compresses the sleeve 32 to hold the ring 12 against the front surface 24.

Accordingly, the display 10 has a pin 30 and sleeve 32 which can be moved to a variety of cavities 28 with no need to replace or add pins. The pin 30 and sleeve 32 provide an extremely reliable holding power for various cylindrical ring like objects to be held at desired angles and positions. Many shapes of recesses 22 and cavities 28 can utilize pin 30 and sleeve 32 combinations. The cavities 28 especially in transparent material bases 18 also provide an ornamental appearance.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A display for holding objects comprising:

a base having a recess;

a projection extending from said base and into said recess; and a compressible sleeve disposed about said projection to hold a portion of an object in said recess between said sleeve and said base.

2. A display as set forth in claim 1 wherein said base has an upper surface and said recess extends from said upper surface into said base.

3. A display as set forth in claim 2 wherein said recess is generally elongated and concave.

4. A display as set forth in claim 2 wherein said recess has a front surface extending at an angle from said upper surface into said base and a rear surface extending at an angle from said front surface to said upper surface.

5. A display as set forth in claim 1 wherein said base is made of a rigid material.

6. A display as set forth in claim 1 wherein said base has a cavity extending from said recess into said base.

7. A display as set forth in claim 6 wherein said projection has a portion disposed in said cavity.

8. A display as set forth in claim 1 wherein said projection is a cylindrical pin.

9. A display as set forth in claim 1 wherein said projection is made of a semi-rigid material.

10. A display as set forth in claim 1 wherein said compressible sleeve is made of compressible material.

11. A display as set forth in claim 1 wherein said sleeve is a cylindrical tube.

12. A display for holding jewelry comprising:

a base having a recess;

a cylindrical pin extending from said base and into said recess; and a compressible sleeve disposed about said pin to hold a portion of a ring like object in said recess between said sleeve and said base.

13. A display as set forth in claim 12 wherein said base has an upper surface and said recess extends from said upper surface into said base.

14. A display as set forth in claim 13 wherein said recess has a front surface extending at an angle from said upper surface into said base and a rear surface extending at an angle from said front surface to said upper surface.

15. A display as set forth in claim 14 wherein said base has a cavity extending from said rear surface into said base.

16. A display as set forth in claim 15 wherein said pin has a portion disposed in said cavity.

17. A display as set forth in claim 12 wherein said base is made of a rigid material.

18. A display as set forth in claim 9 wherein said projection is made of a semi-rigid material.

19. A display for holding a ring comprising:

a base having an upper surface with a recess extending from said upper surface into said base, said recess having a front surface extending at an angle from said upper surface into said base and a rear surface extending at an angle from said front surface to said upper surface;

a cylindrical pin extending from said rear surface and into said recess; and a compressible sleeve disposed about said pin to hold a portion of a ring in said recess between said sleeve and said base.

* * * * *